US008567509B1

(12) United States Patent
Kippola et al.

(10) Patent No.: US 8,567,509 B1
(45) Date of Patent: Oct. 29, 2013

(54) DOWNHOLE TOOL

(71) Applicant: Petroquip Energy Services, LLP, Waller, TX (US)

(72) Inventors: Kevin Scott Kippola, Katy, TX (US); Tracy Dean Blanton, Cypress, TX (US); Todd Ulrich Chretien, Cypress, TX (US); William John Darnell, Cypress, TX (US); Rodney Wayne Long, Cypress, TX (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 13/857,101

(22) Filed: Apr. 4, 2013

(51) Int. Cl.
*E21B 34/10* (2006.01)

(52) U.S. Cl.
USPC ..... 166/373; 166/386; 166/334.1; 166/334.4; 166/374

(58) Field of Classification Search
USPC ..... 166/334.1, 334.4, 373, 374, 386
See application file for complete search history.

(56) References Cited

U.S. PATENT DOCUMENTS

| | | | | |
|---|---|---|---|---|
| 5,261,486 | A * | 11/1993 | Cornette et al. | 166/51 |
| 7,237,611 | B2 * | 7/2007 | Vincent et al. | 166/285 |
| 8,157,012 | B2 | 4/2012 | Frazier | |
| 8,267,178 | B1 * | 9/2012 | Sommers et al. | 166/334.4 |
| 8,272,443 | B2 | 9/2012 | Watson et al. | |
| 2004/0129423 | A1 | 7/2004 | Eddison | |
| 2009/0255685 | A1 | 10/2009 | Nazir et al. | |

* cited by examiner

*Primary Examiner* — David Bagnell
*Assistant Examiner* — Richard Alker
(74) *Attorney, Agent, or Firm* — Buskop Law Group, PC; Wendy Buskop

(57) ABSTRACT

A downhole tool and method for performing to provide a flow path from an inner bore thereof to a wellbore annulus, wherein the flow path is provided upon the application of pressure.

8 Claims, 4 Drawing Sheets

DOWNHOLE TOOL

FIELD

The present embodiments generally relate to a downhole tool that is configured to provide a flow path from an inner bore thereof to a wellbore annulus.

BACKGROUND

A need exists for a downhole tool that is configured to provide a flow path from an inner bore thereof to a wellbore annulus, wherein the flow path is not opened until at least one pressure cycle is completed. Thereby, allowing a pressure test or other operations requiring pressure to be applied to the inner bore of the downhole tool to be performed without opening fluid flow between the inner bore and a wellbore.

The present embodiments meet these needs.

BRIEF DESCRIPTION OF THE DRAWINGS

The detailed description will be better understood in conjunction with the accompanying drawings as follows.

Figure 1A:
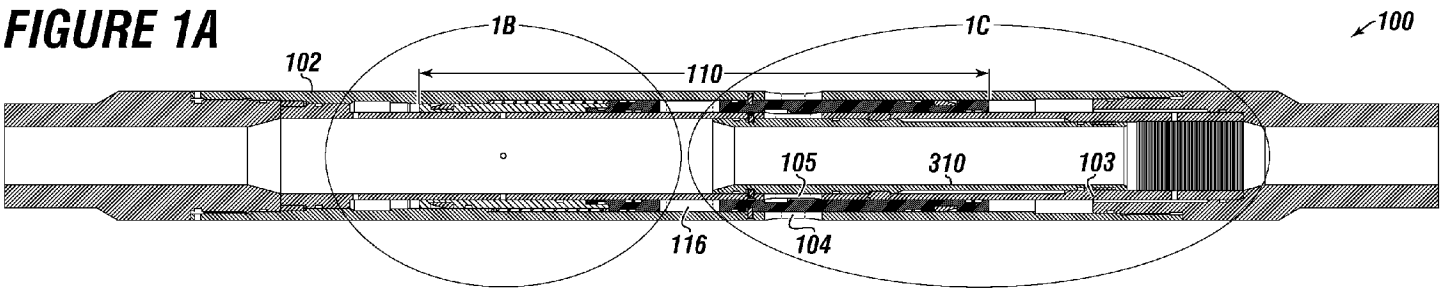
FIG. 1A depicts a downhole tool in a set condition.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a downhole tool that is configured to provide a flow path from an inner bore thereof to a wellbore annulus.

The downhole tool can have a first sleeve comprising at least two portions. The first portion can have a larger outer diameter than a second portion. In a first position, pressure applied to an inner bore of the downhole tool can be allowed to act on a first end of the first portion and an end of the second portion. Due to the difference in the diameters of the first portion and the second portion, an unbalanced force can be formed, causing the first sleeve to move in a first direction from the first position. The first sleeve can move to a second position. In the second position pressure can act on the first end of the first portion and a second end of the first portion, but the pressure can bypass the second portion. The unbalanced force can be eliminated because both ends of the first portion have the same diameter or substantially similar diameters.

In one or more embodiments, one or more first sleeve release devices can be used to fix the position of the first sleeve relative to the downhole tool until a predetermined force is applied to the inner bore of the downhole tool. The one or more first sleeve release devices can be shear pins, shear screws, lock rings, or the like. The one or more first sleeve release devices can be configured to release the first sleeve when a pressure application greater than the normal state pressure in a wellbore is applied to the inner bore.

A force generating device can be located between the portions of the first sleeve. The force generating device can create a force that moves the first portion back towards the first position. The force generating device can be a spring, a compressed gas chamber, a solenoid, or other like devices.

The downhole tool can also include a second sleeve disposed within the inner bore of an inner housing. The second sleeve can be temporally attached with the inner housing with a release mechanism. The release mechanism can be a set of lugs, c type lock ring, or a collet. The release mechanism can be configured to release the second sleeve when a notch in the first portion is aligned with the release mechanism and a second threshold pressure above a second predetermined pressure is applied to the downhole tool. The second sleeve opens a flow path through an inner bore of the downhole tool to an environment external the downhole tool when the second sleeve moves.

In one or more embodiments, one or more second sleeve release devices can be used to keep the second sleeve in a first position relative to the downhole tool until a predetermined pressure is applied to the inner bore of the downhole tool. The predetermined force can be greater than the force required to release the one or more first sleeve release devices, but less than the force required or desired to move the second sleeve and release the release mechanism. The one or more second sleeve release devices can be shear pins, shear screws, lock rings, or the like.

The downhole tool can have an outer housing. A first flow port can be formed therethrough. An inner housing can have a second flow port formed therethrough. The inner housing can be a mandrel or the like. The first sleeve can be disposed between the inner housing and the outer housing.

The present embodiments also relate to a method of operating a downhole tool, wherein operation allows at least one pressure cycle to be performed prior to opening a flow path between and inner bore of the downhole tool and a wellbore.

The method can include applying a first threshold pressure to an inner bore of a downhole tool, thereby moving the first sleeve in a first direction, and bypassing the second portion to equalize pressure acting on the first portion when the first sleeve is in a second position. The first threshold pressure can be a predetermined pressure that is configured to release the first sleeve and move the first sleeve. The first threshold pressure can be determined based on normal state pressure in the wellbore, required test pressures, or other design criteria.

The method can also include allowing the pressure in the inner bore of the downhole tool to fall below the first threshold pressure, and moving the first portion using the force generating device in a second direction. The force generating device can move the first portion aligning a first section having a notch located thereon with the locking mechanism and a second section having a flow path formed therethrough with additional flow paths formed through an inner housing of the downhole tool and an outer housing of the downhole tool.

The method can also include applying a second threshold pressure to the downhole tool, wherein the second threshold pressure urges the second sleeve, and the locking mechanism moves into the notch. When the locking mechanism moves into the notch, the second sleeve can be released and move from its original position, allowing fluid communication to be established through the flow paths. The flow paths allow fluid communication between the inner bore of the downhole tool and an area external the downhole tool. The second threshold pressure can be determined based on desired design principals. The second threshold pressure is the pressure that moves the second sleeve. If second sleeve release devices are used, the second threshold pressure can be incremental higher than the pressure required to release the one or more second sleeve release devices.

Figure 1B:
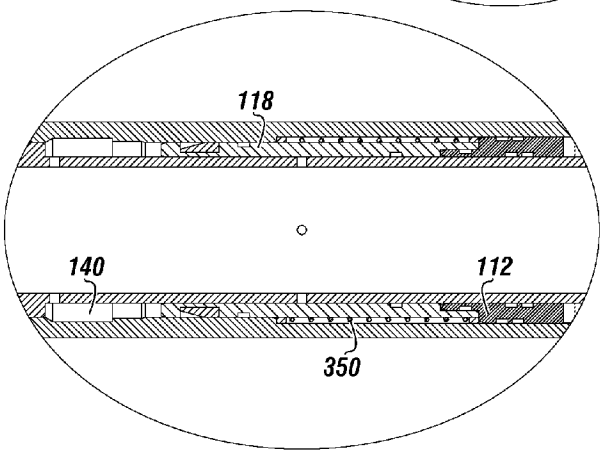
FIG. 1B depicts a detailed view of a second portion of a first sleeve.
Figure 1C:
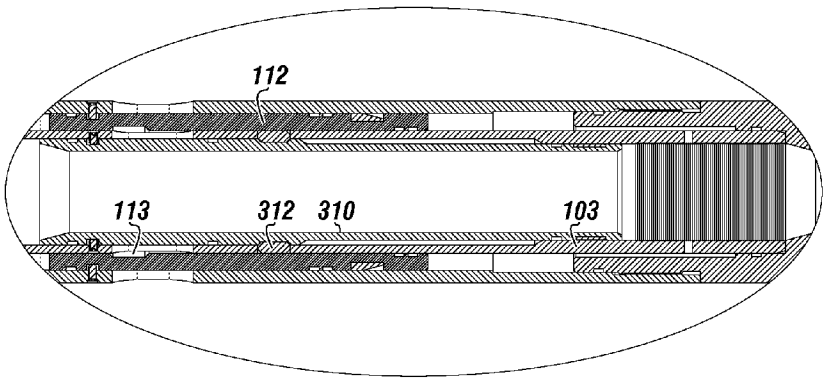
FIG. 1C depicts a detailed view of a first portion of a first sleeve.

Turning now to the Figures, FIG. 1A depicts a downhole tool in a set condition. FIG. 1B depicts a detailed view of a second portion of a first sleeve. FIG. 1C depicts a detailed view of a first portion of a first sleeve.

The downhole tool 100 can be located within a wellbore, the wellbore is not depicted. The downhole tool 100 can have an outer housing 102. The outer housing can have a first flow port 104 formed therethrough. The outer housing 102 can be concentrically aligned with an inner housing 103. A second flow port 105 can be formed in the inner housing 103 and aligned with the first flow port 104. A second sleeve 310 can be located between the second flow port 105 and the inner bore of the downhole tool 100. The second sleeve 310 can be locked in place by at least a locking mechanism 312.

A first sleeve 110 can be located between the outer housing 102 and the inner housing 103. The first sleeve 110 can have a first portion 112 and a second portion 118. A notch 113 and a third flow port 116 can be formed in the first portion 112. In the first position, the first portion 112 and the second portion 118 can be in fluid communication with an inner bore of the inner housing 103. One or more seals, such as O-rings, can be operatively located on the first sleeve, the inner housing, the outer housing, or combinations thereof to form a pressure chamber between the inner housing and the outer housing. A force generating device 350 can be located between the first portion 113 and the second portion 118.

A key 140 can be located between the inner housing 103 and the outer housing 102. The key 140 can be configured to reduce rotation of the first sleeve 110.

Figure 2A:
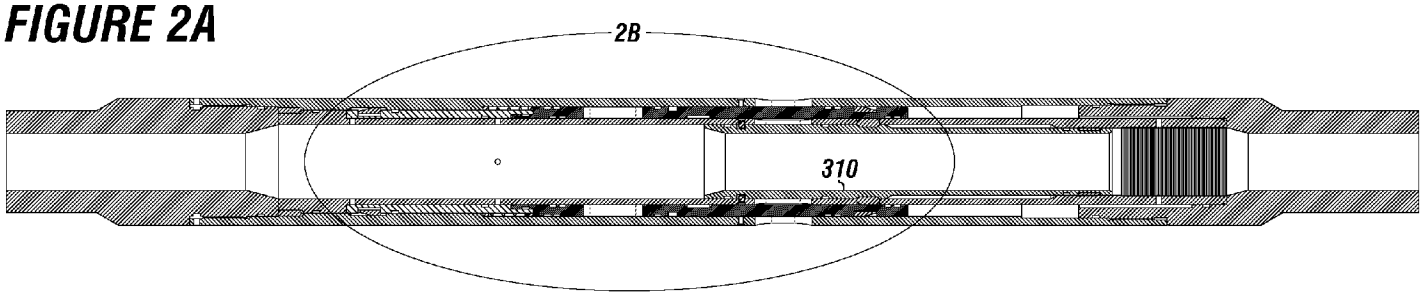
FIG. 2A depicts the downhole tool after a first threshold pressure is applied to the inner bore.
Figure 2B:
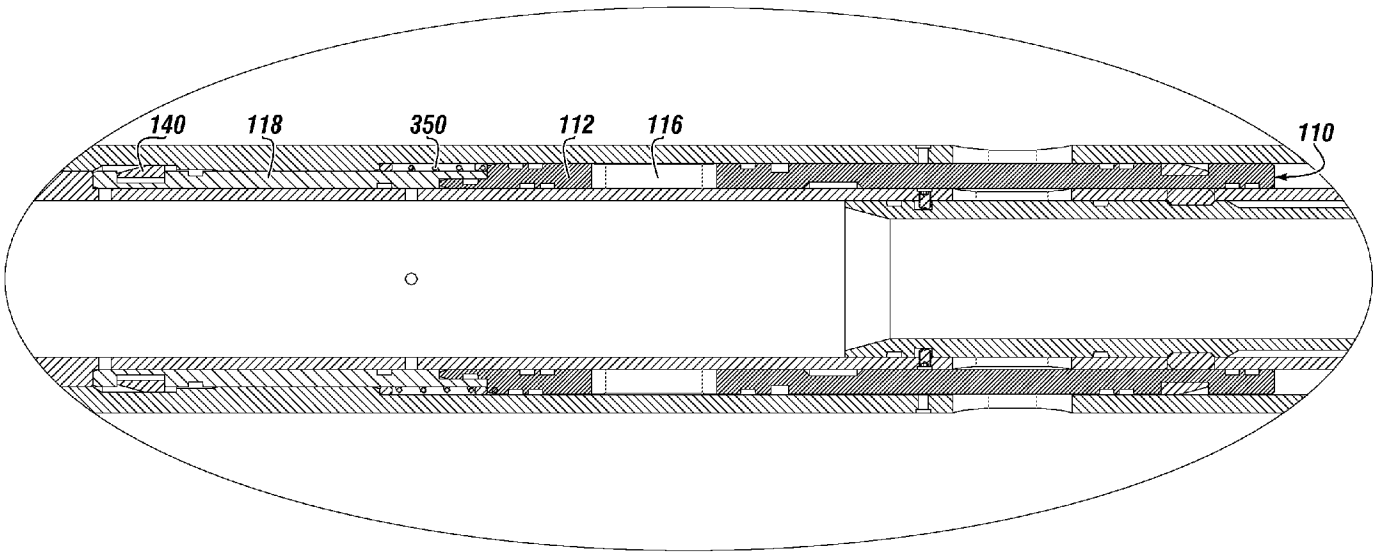
FIG. 2B depicts a detailed view of a portion of the downhole tool after a first threshold pressure is applied to the inner bore.

FIG. 2A depicts the downhole tool after a first threshold pressure is applied to the inner bore. FIG. 2B depicts a detailed view of a portion of the downhole tool after a first threshold pressure is applied to the inner bore.

The first sleeve 110 can move to a second position when a first threshold pressure is applied to the inner bore of the inner housing. The first threshold pressure can be a pressure higher than the determined wellbore pressure.

The second portion 118 can be engaged with the key 140. The third flow port 116 is not aligned with other flow ports, and the pressure in the inner bore of the inner housing can bypass the second portion 118 when the first sleeve 110 is in the second position. For example, an opening can be formed between a seal on the second portion and the outer housing, allowing pressure to bypass the second portion; a short circuit port can be opened when the first sleeve is in the second position, allowing the pressure to bypass the second portion; or the like.

The second sleeve 310 can remain in its original position due to at least the locking mechanism of FIG. 1. In one or more embodiments, one or more shear screws can also be used with the locking mechanism. The shear screws can be used to ensure that premature movement of the second sleeve does not occur. The bleed threshold pressure can be less than the first threshold pressure, for example the bleed threshold pressure can be the determined wellbore pressure.

The first portion 112 and the force generating device 350 are also shown.

Figure 3A:
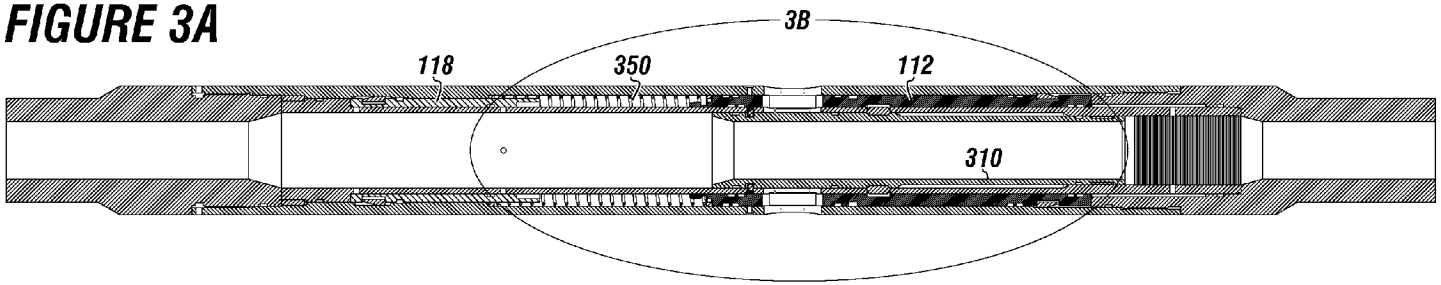
FIG. 3A depicts the downhole tool after the first threshold pressure drops to a bleed threshold pressure.
Figure 3B:
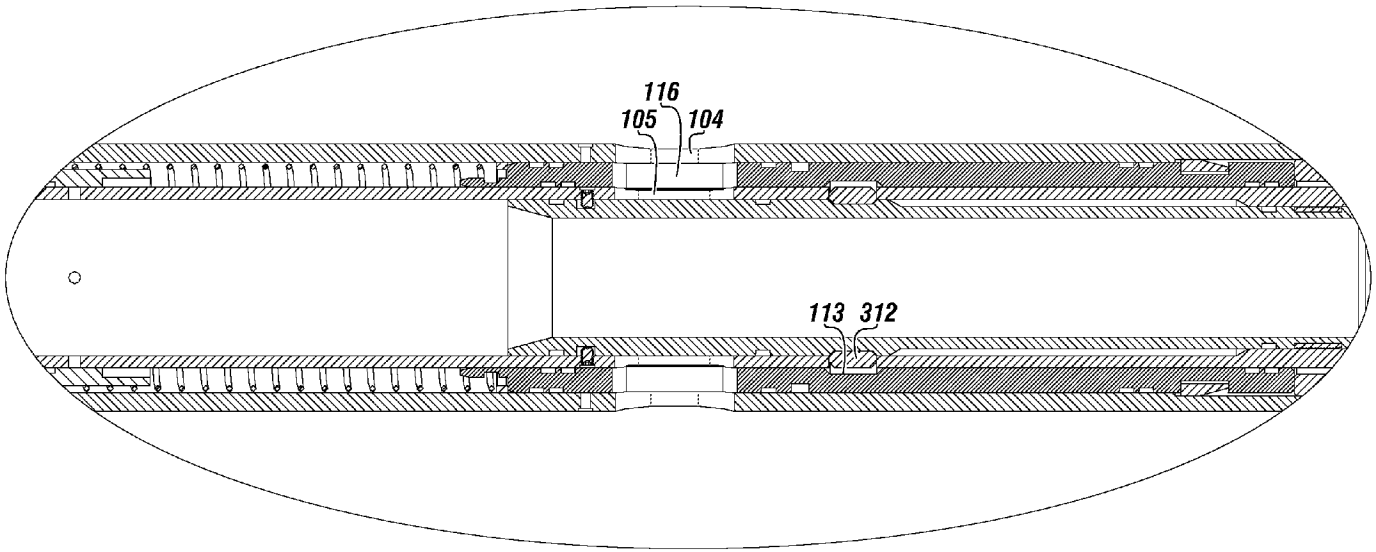
FIG. 3B depicts a detail view of a portion of the downhole tool after the first threshold pressure drops to a bleed threshold pressure.

FIG. 3A depicts the downhole tool after the first threshold pressure drops to a bleed threshold pressure. FIG. 3B depicts a detail view of a portion of the downhole tool after the first threshold pressure drops to a bleed threshold pressure.

The first portion 112 can be moved back towards the first position when the bleed threshold pressure is reached. The first portion 112 can be moved by the force generating device 350. The first portion 112 can be moved until the third flow port 116 is aligned with the first flow port 104 and the second flow port 105, and the notch 113 is aligned with the locking mechanism 312.

The second sleeve 310 can remain in its original position due to at least the locking mechanism 312. The second sleeve 310 can block fluid communication between the second flow port 105 and the inner bore of the downhole tool.

The second portion 118 is also shown.

Figure 4A:
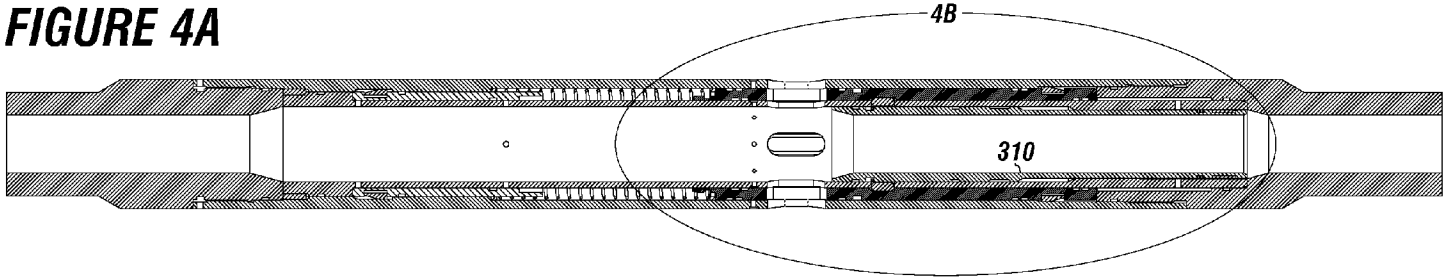
FIG. 4A depicts a downhole tool after a second threshold pressure is applied to the inner bore.
Figure 4B:
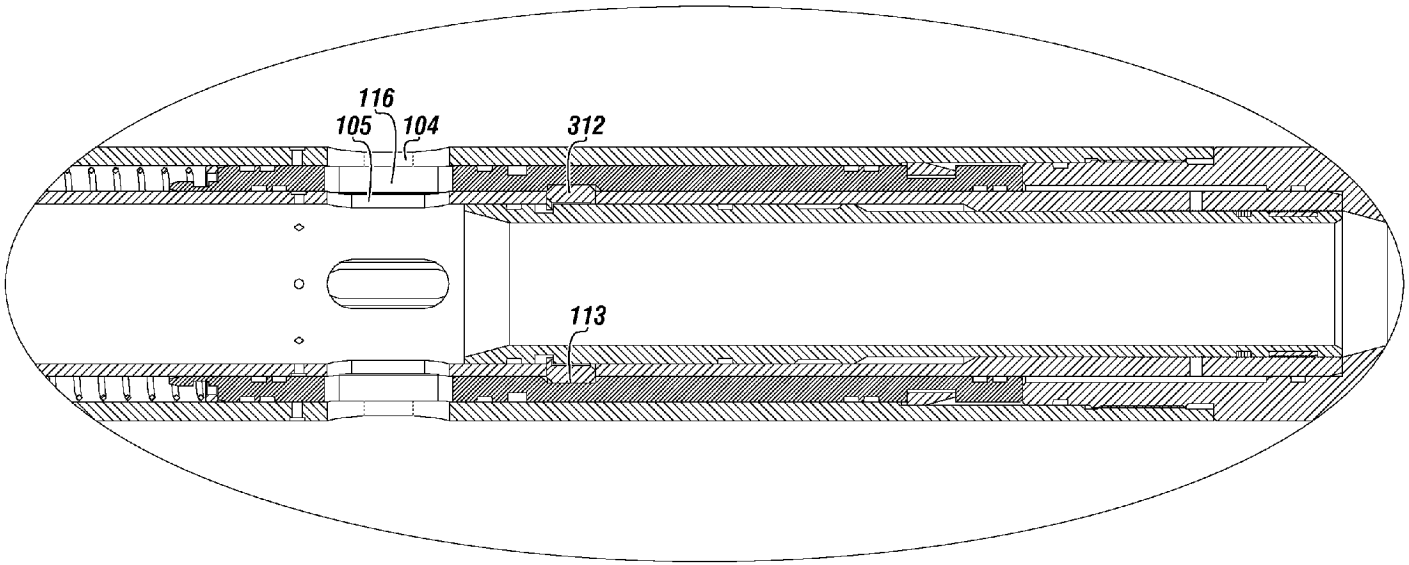
FIG. 4B depicts a detail of a portion of the downhole tool after a second threshold pressure is applied to the inner bore.

FIG. 4A depicts a downhole tool after a second threshold pressure is applied to the inner bore. FIG. 4B depicts a detail of a portion of the downhole tool after a second threshold pressure is applied to the inner bore.

The second threshold pressure can urge the second sleeve 310. As the second sleeve is urged, the locking mechanism 312, due to angles and forces provided by the second sleeve, can move into the notch 113, releasing the second sleeve 310.

The second sleeve 310, now free to move, can move away from its original position. When the second sleeve 310 moves away from its original position, the second flow port 105 formed in the inner housing can be uncovered. Accordingly, the first flow port 104, the second flow port 105, and the third flow port 116 can be in fluid communication, and a flow path from the inner bore of the inner housing to an environment external of the downhole tool can be created.

While these embodiments have been described with emphasis on the embodiments, it should be understood that within the scope of the appended claims, the embodiments might be practiced other than as specifically described herein.

What is claimed is:

1. A downhole tool, wherein the downhole tool is configured to provide a flow path from an inner bore thereof to a wellbore annulus after at least two pressure cycles, wherein the downhole tool comprises:

a. an outer housing having a first flow port formed therethrough;

b. an inner housing having a second flow port formed therethrough;

c. a first sleeve disposed between the inner housing and the outer housing, wherein the first sleeve has a first portion and a second portion, wherein a force generating device is disposed between the first portion and the second portion, wherein the first portion has a diameter that is smaller than the second portion, and wherein a third flow port is formed through the second portion; and d. a second sleeve disposed within the inner bore of the inner housing, wherein the second sleeve is temporarily attached with the inner housing with a release mechanism, and wherein the second sleeve blocks the second flow port formed through the inner housing.

2. The downhole tool of claim 1, wherein the first sleeve moves in a first direction when a first threshold pressure is applied to the inner bore.

3. The downhole tool of claim 2, wherein the second portion moves in a second direction when the first threshold pressure drops below a threshold pressure, wherein the movement of the second portion is aided by the force generating device.

4. The downhole tool of claim 3, wherein the third flow port is aligned with the second flow port and the first flow port when the second portion moves in the second direction.

5. The downhole tool of claim 3, wherein the second sleeve is released from the inner housing when a second threshold pressure is applied to the inner bore, and wherein when the second sleeve moves, the annulus of the wellbore is placed in fluid communication with the inner bore of the downhole tool.

6. The downhole tool of claim 5, wherein the second threshold pressure is less than the first threshold pressure.

7. A downhole tool, wherein the downhole tool is configured to provide a flow path from an inner bore thereof to a wellbore annulus, wherein the downhole tool comprises:

a. a first sleeve comprising at least two portions, wherein a first portion has a larger outer diameter than a second portion, wherein a first threshold pressure acts on a first end of the first portion and an end of the second portion to move the first sleeve in a first direction from a first position, and wherein pressure acts on the first end of the first portion and a second end of the first portion when the first sleeve is in a second position;

b. a force generating device for moving the first portion in towards the first position; and c. a second sleeve disposed within the inner bore of an inner housing, wherein the second sleeve is temporarily attached with the inner housing with a release mechanism, wherein the release mechanism is configured to release the second sleeve when a notch formed in the first portion is aligned with the release mechanism and a second threshold pressure is applied to the downhole tool, and wherein the second sleeve opens a flow path through an inner bore of the downhole tool to an environment external the downhole tool.

8. A method of operating a downhole tool, wherein operation allows at least one pressure cycle to be performed prior to opening a flow path between an inner bore of the downhole tool and a wellbore; wherein the method comprises:

a. applying a first threshold pressure to the inner bore of the downhole tool, thereby moving a first sleeve in a first direction, wherein the first sleeve comprises at least two portions, wherein a first portion has a larger outer diameter than a second portion;

b. bypassing the second portion to equalize pressure acting on the first portion;

c. allowing pressure in the inner bore to fall below the first threshold pressure;

d. moving the first portion, using a force generating device, in a second direction, wherein the first portion has a notch located thereon and a flow path formed therethrough, and wherein the force generating device is configured to move the first portion in the second direction until the notch is operatively aligned with a locking mechanism connected with a second sleeve, and wherein the flow path is spaced from the notch such that the flow path aligns with additional flow paths formed through an inner housing of the downhole tool and an outer housing of the downhole tool; and e. applying a second threshold pressure to the downhole tool, wherein the second threshold pressure urges the second sleeve, and the locking mechanism moves into the notch releasing the second sleeve, allowing the second sleeve to move, and wherein when the second sleeve moves fluid communication is established through the flow paths, allowing fluid communication between the inner bore of the downhole tool and an area external the downhole tool.

* * * * *